US007191920B2

(12) United States Patent
Boll et al.

(10) Patent No.: US 7,191,920 B2
(45) Date of Patent: Mar. 20, 2007

(54) MOTORIZED HOUSEHOLD LIQUID DISPENSER

(75) Inventors: David Boll, Avon, OH (US); Jeffery Kalman, Cleveland Heights, OH (US); Michael Schiavoni, Euclid, OH (US); Craig M. Saunders, Rocky River, OH (US)

(73) Assignee: Conopco, Inc., Englewood Cliffs, NJ (US)

( * ) Notice: Subject to any disclaimer, the term of this patent is extended or adjusted under 35 U.S.C. 154(b) by 377 days.

(21) Appl. No.: 10/669,761

(22) Filed: Sep. 24, 2003

(65) Prior Publication Data

US 2004/0149779 A1 Aug. 5, 2004

Related U.S. Application Data

(60) Provisional application No. 60/413,310, filed on Sep. 25, 2002.

(51) Int. Cl.
*B65D 88/54* (2006.01)

(52) U.S. Cl. ..... 222/333; 222/382; 222/285

(58) Field of Classification Search ..... 222/333, 222/385, 382, 321.8, 180
See application file for complete search history.

(56) References Cited

U.S. PATENT DOCUMENTS 4,530,449 A * 7/1985 Nozawa et al. ..... 239/333
4,722,372 A 2/1988 Hoffman et al.
4,921,131 A 5/1990 Binderbauer et al.
4,946,070 A 8/1990 Albert et al.
4,967,935 A 11/1990 Celest
5,105,992 A 4/1992 Fender et al.
5,286,106 A 2/1994 Burgos
5,417,258 A * 5/1995 Privas ..... 222/321.8
6,209,752 B1 4/2001 Mitchell et al.
6,390,329 B1 5/2002 Maddox
6,467,651 B1 * 10/2002 Muderlak et al. ..... 222/333
6,533,144 B2 3/2003 Davies et al.
6,568,561 B2 5/2003 Studer et al.
2002/0175182 A1 11/2002 Matthews
2003/0006246 A1 1/2003 Studer et al.
2003/0075562 A1 4/2003 Gerenraich et al.
2003/0075565 A1 4/2003 Gerenraich et al.

* cited by examiner

*Primary Examiner*—Philippe Derakshani

(57) ABSTRACT

A household liquid dispensing apparatus includes a container for holding a household liquid and a pump for pumping the household liquid out of the container. The pump includes a pump chamber. A dip tube is adapted to be positioned in the container and communicates with the pump chamber. An exhaust tube communicates with the pump chamber and an outlet for the household liquid. A pump actuator mechanically drives the pump. A motor operatively engages the pump actuator. The motor is electrically connected to a power source. A switch is electrically connected to the motor and the power source. A trigger assembly is operatively connected to the switch to control power delivered to the motor. The trigger assembly is positioned under the outlet for the household liquid for easy actuation by an upturned hand.

43 Claims, 7 Drawing Sheets

MOTORIZED HOUSEHOLD LIQUID DISPENSER

This application claims priority under 35 U.S.C. § 119(e) to U.S. Provisional Application No. 60/413,310 filed Sep. 25, 2002, which is incorporated by reference.

BACKGROUND OF THE INVENTION

This invention relates to a pumping mechanism. More particularly, this invention relates to a motorized soap dispenser.

In public restrooms along with household bathrooms and kitchens, sanitation is an important concern. Hand washing can greatly reduce the spread of germs. Liquid soap is more and more popular among consumers as the hand soap of choice. Liquid soap is usually dispensed through a hand pump that delivers the liquid soap from a bottle. The user pumps the handle using one hand and the liquid soap is delivered onto the user's other hand.

When a person has particularly dirty hands prior to washing, he may leave some dirt on the hand pump which can create a sanitary problem. Limiting this sanitary problem can reduce the spread of germs. Not only is a dirty hand pump a sanitary problem; a dirty hand pump is an unsightly mess. Eliminating this unsightly mess results in a more attractive soap dispenser. Also, many consumers use more liquid soap than is necessary when washing their hands. Limiting the amount of wasted hand soap, especially at a large facility such as a factory or a sports stadium, can lead to an appreciated economic savings.

Accordingly, it is desirable to provide a hand soap dispenser that is more sanitary than the prior art. It is also desirable to provide a hand soap dispenser that uses less soap than the prior art, while still delivering the proper amount of soap to wash one's hands.

SUMMARY OF THE INVENTION

A household liquid dispensing apparatus includes a container for holding a household liquid and a pump for pumping the household liquid out of the container. The pump includes a pump chamber. A dip tube is adapted to be positioned in the container and communicates with the pump chamber. An exhaust tube communicates with the pump chamber and an outlet for the household liquid. A pump actuator mechanically drives the pump. A motor operatively engages the pump actuator. The motor is electrically connected to a power source. A switch is electrically connected to the motor and the power source. A trigger assembly is operatively connected to the switch to control power delivered to the motor. The trigger assembly is positioned under the outlet for the household liquid.

A household liquid dispenser for use with an associated bottle for storing a household liquid is provided. The dispenser includes a housing and a pump for pumping a household liquid from the associated bottle. The pump is disposed in the housing and includes a pump chamber. A nozzle communicates with the pump chamber and defines an outlet. A pump actuator connects to the pump. A motor operatively engages the pump actuator and electrically connects to a power source. A switch electrically connects to the motor and the power source for selectively supplying power to the motor. A trigger assembly mounts to the housing and selectively mechanically engages the switch.

An apparatus for dispensing a liquid from an associated pump bottle is provided. The associated pump bottle includes a container for storing a household liquid, a pump for pumping the household liquid out of the container, a pump driving member for driving the pump, and an outlet for the household liquid. The apparatus includes a housing, an actuator, a motor, a switch, and a trigger. The housing is adapted to receive the associated pump bottle. The actuator is adapted to engage the pump driving member of the associated pump bottle. The motor is operatively connected to the actuator and electrically connected to a power source. The switch is electrically connected to the motor and the power source for selectively supplying power to said motor. The trigger is attached to the housing such that the trigger is positioned under the outlet of the associated pump bottle when the associated pump bottle is received by the housing. The trigger selectively engages the switch.

An apparatus for pumping liquid from an associated bottle includes a housing, an actuator, a motor, a switch, and a trigger. The housing is adapted to receive an associated pump bottle. The actuator is movably mounted to the housing. The motor is operatively connected to the actuator and electrically connected to a power source. The switch is electrically connected to the motor and the power source for selectively supplying power to the motor. The trigger is movably mounted to the housing such that an opening is defined by the trigger and a wall of the housing. The opening is adapted to receive a portion of the associated pump bottle.

An object of the invention is to provide a hand soap dispenser that is more sanitary than prior art dispensers.

Another object of the invention is reduce the likelihood of an unsightly mess left on a trigger assembly of the soap dispenser.

Yet another object of the invention is to provide a hand soap dispenser that does not waste liquid soap.

Another object of the invention is to provide a soap dispenser that can deliver foam to the user that is easier to lather than conventional liquid soap.

Yet another object of the invention is to provide a soap dispenser that does not require manual pumping by the user.

Another object of the invention is to provide a hand soap dispenser that is inexpensive to manufacture and easy to use.

DETAILED DESCRIPTION OF THE INVENTION

It is to be understood that specific devices and processes illustrated in the attached drawings, and described in the following specification are simply exemplary embodiments of inventive concepts. Hence, specific examples of characteristics relating to the embodiments disclosed herein are not to be considered as limiting.

Figure 1:
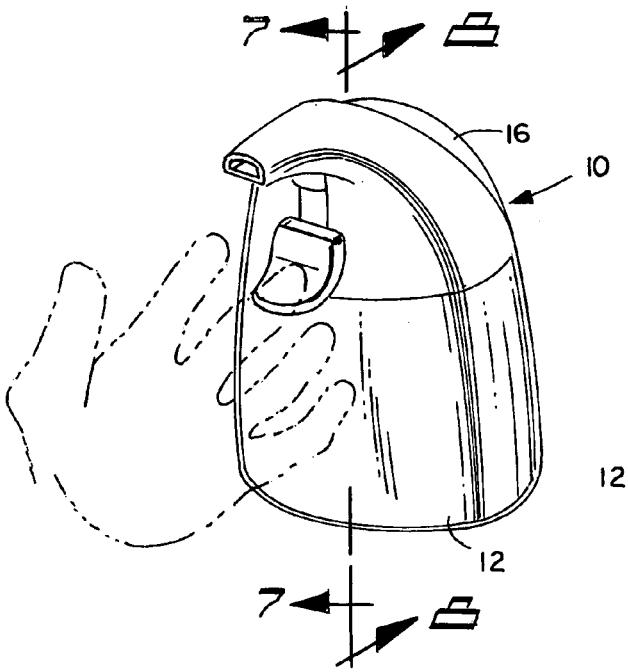
FIG. 1 is front perspective view of a dispenser according to a first embodiment.
Figure 2:
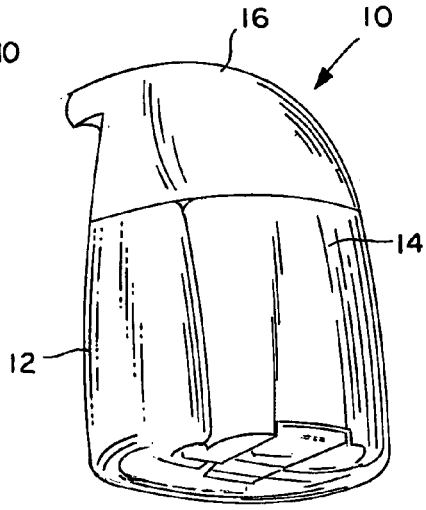
FIG. 2 is a rear perspective view of the dispenser of FIG. 1.

Referring now to FIGS. 1 and 2, a motorized hand soap dispenser 10 includes a container 12, a housing 14 positioned behind the container 12, and a shroud 16 positioned above the container and the housing. Generally, the container stores a liquid, the housing encloses mechanical and electrical components, and the shroud covers a conduit for the liquid. For ease of explanation of the figures only, and not to limit the invention to only that described, the terms "front," "rear," "top," and "bottom," and the like will be used to describe the figures; however, such terms are simply to describe the figures and not to limit the invention to the embodiments described.

Figure 3B:
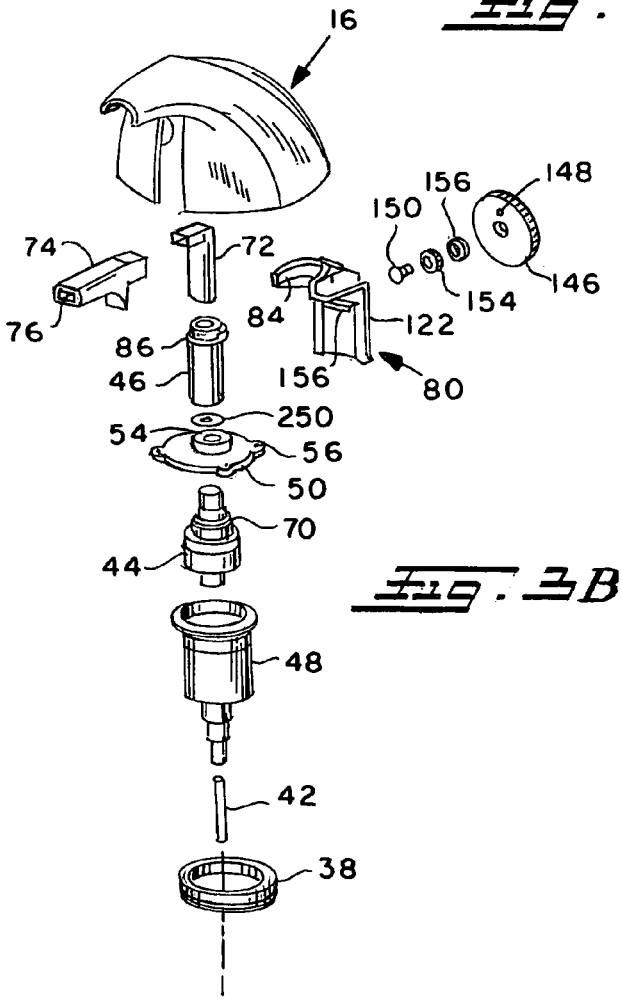
FIG. 3B is an exploded view of the lower portion of the dispenser of FIG. 1.
Figure 3A:
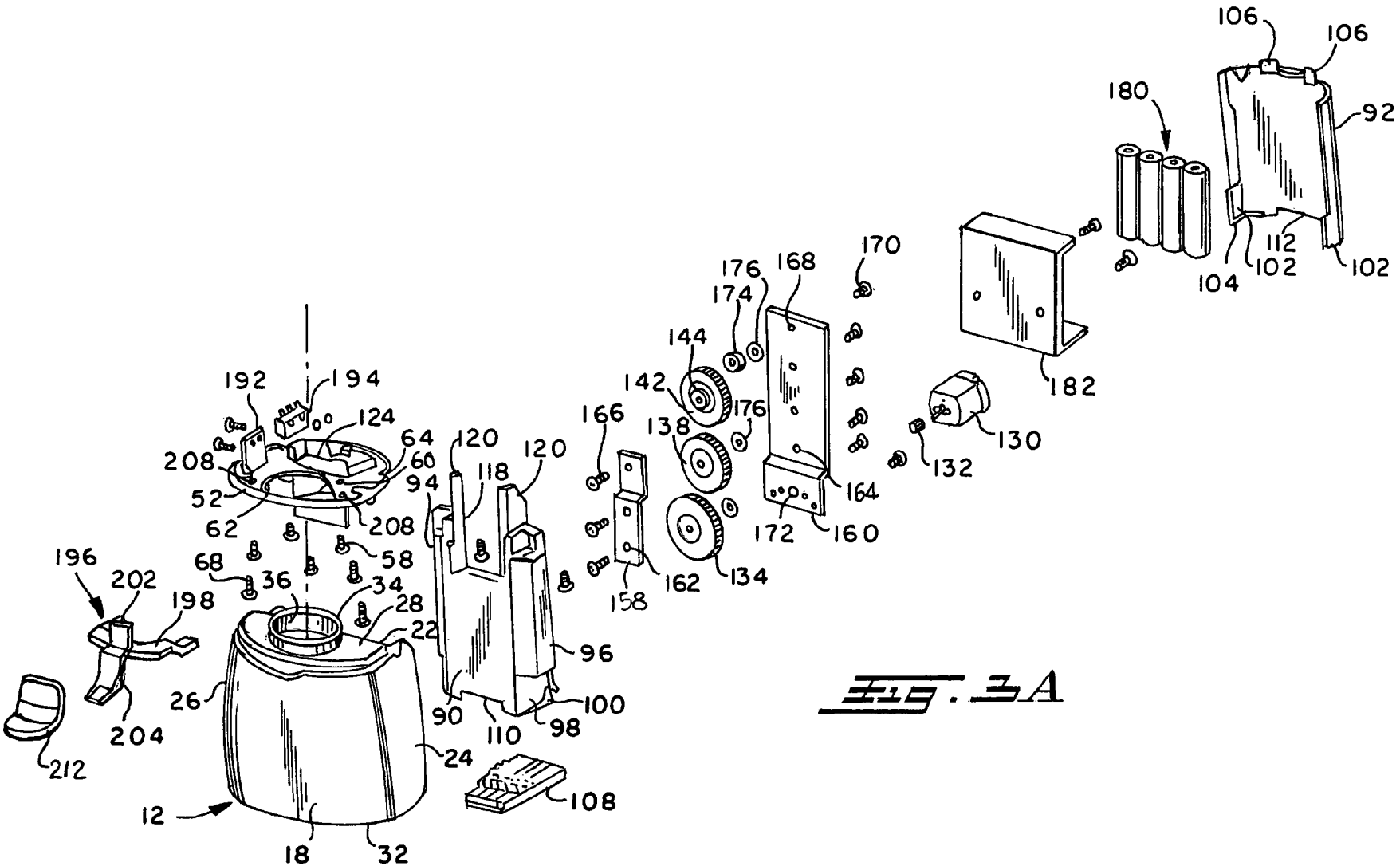
FIG. 3A is an exploded view of the upper portion of the dispenser of FIG. 1.
Figure 7:
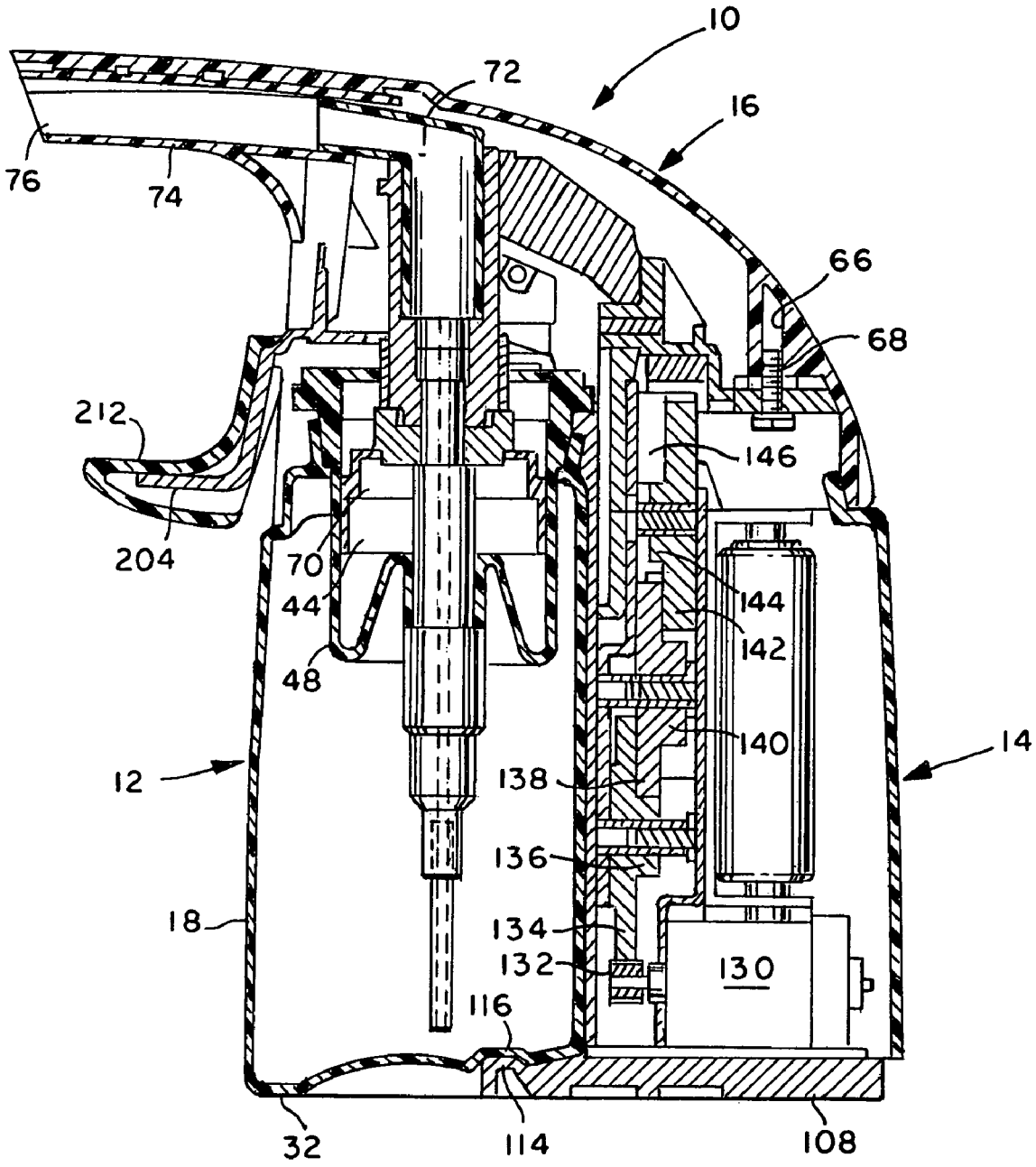
FIG. 7 is a side cross-sectional view of the dispenser of FIG. 1.

The container 12 stores a household liquid such as hand soap, dishwashing soap, shampoo, conditioner and the like. The container can be made of plastic or another durable material. With reference to FIG. 3A, the container includes a front wall 18, a rear wall 22, and side walls 24 and 26. The front wall 18 in the preferred embodiment is rounded or arcuate for an aesthetically pleasing appearance; however, the front wall can be another suitable shape. The rear wall 22 is substantially flat or planar. The side walls 24 and 26 extend beyond the central portion of the rear wall 22. The rear wall thus defines an indented central portion or notch. The container further includes a top wall 28 and a base wall 32. A neck 34, which in this embodiment is circular, is positioned on the top wall 28 and defines an opening 36. A container seal 38 (FIG. 3B) can be positioned in the circular neck 34. The base wall 32 has a central indented portion, as seen in FIG. 7.

A pump assembly draws the household liquid from the container 12. Referring to FIG. 3B, the pump assembly includes a dip tube 42, a pump diaphragm 44, and an exhaust tube 46. The pump diaphragm 44 is disposed in a pump housing 48. The dip tube 42 communicates with the pump diaphragm 44 which includes a pump chamber (not visible) that communicates with the exhaust tube 46 to draw liquid out of the container. The dip tube 42 can include an intake check valve (not shown). The intake check valve can be positioned anywhere upstream of the pump chamber. The exhaust tube 46 can also include an exhaust check valve (not shown); however, the exhaust check valve can be positioned anywhere downstream of the pump chamber. Alternatively, a single check valve can be disposed in the pump diaphragm. The pump diaphragm 44 and the pump housing 48 can compromise a positive displacement pump similar to a traditional hand soap pump powered by a user depressing on a nozzle.

A disc 50 attaches to a plate 52 (FIG. 3A) to sandwich the top of the diaphragm 44 and the pump housing 48 between the two. The diaphragm 44 is thus retained in a closed volume defined by the pump housing 48 and the disc 50. The disc 50 includes an opening 54 that receives the exhaust tube 46. The exhaust tube 46 moves up and down inside the opening 54. The disc 50 further includes apertures 56 that receive fasteners 58 (FIG. 3A), which are received in apertures 60 in the plate 52 to attach the disc to the plate. The plate includes an opening 62 to receive the pump housing 48. The plate opening 62 surrounds the neck 34 of the container and aligns with the container opening 36 such that the pump housing can be received in the container 12. The plate 52 is attached to the shroud 16 so that when the shroud is lifted the pump assembly is removed from the container 12. The plate includes holes 64 that align with holes 66 (only one shown in FIG. 7) in the shroud 16. The holes 64 and 66 receive conventional fasteners 68 fixing the plate to the shroud 16.

Referring back to FIG. 3B, the exhaust tube 46 slides up and down in the disc opening 54 working a plunger 70 which is part of the pump diaphragm 44. The plunger 70 is the working member for the pump assembly. A nozzle 72 is received by the exhaust tube 46. The nozzle 72 includes about a 90 degree bend. The nozzle 72 attaches to a nozzle extension 74, which provides an outlet 76 for the household liquid. In use, the household liquid is drawn through the dip tube 42 into the pump chamber of the pump diaphragm 44 and through the exhaust tube 46, the nozzle 72 and finally the nozzle extension 74 before reaching the outlet 76 at the distal end of the nozzle extension.

The exhaust tube 46 and thus the pump assembly, is driven by a pump actuator 80 (FIG. 3B). The pump actuator 80 includes a horseshoe shaped member 82 having a receiving slot 84 around the inner surface of the horseshoe shaped member that receives an apron 86 of the exhaust tube 46. The pump actuator 80 is driven by a motor and transmission assembly contained in the housing 14. The housing 14 is seen in an exploded view in FIG. 3A.

The housing 14 can be made of plastic or another suitable material. The housing 14 includes a front or first panel 90 and a rear or second panel 92. The front panel 90 and the container rear wall 22 are complementarily shaped such that the front panel 90 is shaped to be received in the central indented portion or notch defined by the side walls 24 and 26 and the rear wall 22 of the container 12. In the embodiment depicted in FIGS. 1 and 2, the front panel 90 includes a planar portion that abuts the rear wall 22 of the container 12. Other complementary shapes are contemplated, including those depicted in FIGS. 4A, 5 and 6.

The front panel 90 includes a right side wall 94 and a left side wall 96. The right side wall 94 is a mirror image of the left side wall 96. The side walls have lower side notches 98 having front tabs 100 (only one visible in FIG. 3) positioned in the notches. The rear panel 92 includes lower side flanges 102 having rear tabs in 104 (only one shown). The lower side flanges 102 are resilient such that the rear tabs 104 fit over the front tabs 100 to attach the front panel 90 to the rear panel 92. The rear panel 92 also includes upper tabs 106 at its top that fit into a mating portion of the shroud 16.

A latch plate 108 is provided to hold the container 12 in a fixed relation to the housing 14. Both the front panel 90 and the rear panel 92 include notches 110 and 112 respectively that slidably receive the latch plate 108. Referring to FIG. 7, the latch plate 108 includes a protrusion or tongue 114 that is received in a depression or groove 116 in the base wall 32 of the container 12. As is also noticeable from FIG. 7, the bottom of the latch plate 108 is level with the bottom most portion of the base wall 32 of the container 12, so that the dispenser 10 can sit level on a surface.

Referring back to FIG. 3A, the front panel also includes a deep notch 118 defined by two upwardly extending projections 120, which are mirror images of one another. The pump actuator 80 (FIG. 3A) is received in the deep notch 118. The actuator 80 includes two side channels 122 (only one shown) that slide along the projections 120. The pump actuator reciprocates up and down in the notch 118 to drive the pump assembly. The projections 118 are received inside an opening 124 in the plate 52 (FIG. 3A), which secures the front panel 90 firmly behind the rear wall 22 of the container 12.

As mentioned earlier, a motor 130 through a plurality of gears drives the pump actuator 80. The motor 130 drives a pinion 132. The pinion 132 drives a first intermediate gear 134. A first intermediate pinion 136 (FIG. 7) is attached to the first intermediate gear 134, and is driven along with the first intermediate gear. The first intermediate pinion 136 drives a second intermediate gear 138. The second intermediate gear 138 has a second intermediate pinion 140 (FIG. 7) attached to and driven along with the second intermediate gear. The second intermediate pinion 140 drives a third intermediate gear 142. The third intermediate gear 142 has a third intermediate pinion 144 attached to and driven along with the third intermediate gear. The third intermediate pinion 144 drives a drive gear 146 (FIG. 3B).

The drive gear 146 includes a hole 148 offset from its center. A pin 150 is mounted in the hole 148 and carries an inner sleeve 152 and an outer sleeve 154. The pin 150 engages a slot 156 in the pump actuator. The pin and slot converts the rotational movement of the drive gear 146 into reciprocating movement of the actuator 80. In an alternative embodiment, such a mechanism can include a rack and pinion; however, a reversing electric motor would be used. Other conventional mechanisms can be used to convert the rotational movement into a reciprocal movement. The transmission disclosed is a gear reduction transmission that translates the high RPM output of the motor 130 to a lower RPM rotation for the drive gear 146, other conventional transmissions can also be used to drive the pump actuator The intermediate gears 134, 138 and 142 are sandwiched between a front gear plate 158 and a rear gear plate 160. The front gear plate 158 includes axle openings 162 that are aligned with axle openings 164 in the rear plate 160. Axles 166 are received in the openings 162 and 164 to fix the gears between the front gear plate 158 and the rear gear plate 160. The rear gear plate 160 includes an additional axle opening at its top 168 that receives a fastener 170 for the drive gear 146. The rear gear plate 160 also includes a pinion opening 172 through which the pinion 132 protrudes. A spacer 174 and bushings 176 can be provided to appropriately space the gears between the front gear plate 158 and the rear gear plate 160.

The motor 130 receives power from a power source 180. The power source 180 in the preferred embodiment is a plurality of batteries. The batteries are received in a battery pack 182 that is electrically connected to the motor 130 in a conventional manner. In an alternative embodiment, the power source could be an AC power source or any suitable power source.

The plate 52 associated with the shroud 16 (FIG. 3A) further includes a mounting wall 192 projecting upwardly from the plate 52 to which a switch 194 is mounted. The switch 194 is electrically connected to the motor 130 and the power source 180 in a conventional manner. The switch 194 is activated by a trigger assembly that includes a switch actuator 196. The switch actuator 196 includes a U-shaped member 198, an upward projection 202, and a downward L-shaped projection 204. The U-shaped member 198 surrounds the neck 34 of the container 12. The U-shaped member 198 mounts on fulcrums 208 extending upwardly from the plate 52. The downward L-shaped projection 204 limits the pivotal movement of the switch actuator 196 by contacting the front wall 18 of the container 12. As more clearly seen in FIG. 7, the downward L-shaped projection 204 is spaced slightly from the front wall 18 of the container 12. The switch 194 is designed to activate with minimal force so that the switch actuator 196 need only to be barely depressed before the pump is actuated. The trigger assembly also includes a trigger pad 212 that mounts to the switch actuator 196 over the L-shaped projection 204. The trigger pad 212 provides a rounded surface that complements the back of a user's hand or fingernail such that slight depression on the trigger 212 will result in the deposit of the household liquid on the upward facing palm of the user. Lateral force against the trigger pad 212 also activates dispensing. In an alternative embodiment, the housing 14 or the shroud 16 can limit the movement of the switch actuator 196.

In use, a consumer depresses the trigger pad 212 with the downwardly facing surface of a cupped hand causing the L-shaped projection 204 of the switch actuator 196 to rotate slightly on the fulcrums 208 about an axis defined at the intersection of the L-shaped projection 204 and the U-shaped member 198. Upon rotation of the switch actuator 196, the end of the U-shaped member 198 is forced upwardly closing the switch 194. With the switch closed, the circuit between the motor 130 and the power source 180 is closed; therefore, power is delivered from the power source to the motor. When the user has enough soap, the hand is raised and dispensing ceases.

Other trigger assemblies can be used to activate the trigger assembly, including an optical sensor and other known mechanisms. Furthermore, the shape of the trigger can be modified. In the particular embodiment described above, the trigger pad is adapted to be depressed by the back of the user's hand. In other embodiments, perhaps where the bottle is storing a liquid that is different from hand soap, the shape of the trigger can be modified.

The trigger assembly is positioned below the outlet of the nozzle 74 such that the hand or object used to depress the trigger pad 212 is in position to receive the household liquid. In one embodiment, the soap dispenser provided allows the user to lightly depress the trigger pad with the back of the user's finger to dispense the soap. This remedies the problem of requiring the user to depress a hand pump with a dirty hand. Since the back of one's hand is usually not soiled, dirt will not likely be deposited on the trigger when the trigger is depressed. The amount of force required to activate the trigger and thus the switch is much smaller than the amount of force required to depress the hand pump of a conventional hand soap pump. Accordingly, less dexterity is needed to use the motorized dispenser than a conventional hand pump soap dispenser. Furthermore, the dispenser can be used to deposit dishwashing soap onto a dirty plate, pot or pan. In such a case, the user can depress the trigger pad with the dirty plate, pot or pan and the plate, pot or pan is positioned to receive the dishwashing soap.

Figures 4A, 4B, 5, 6:
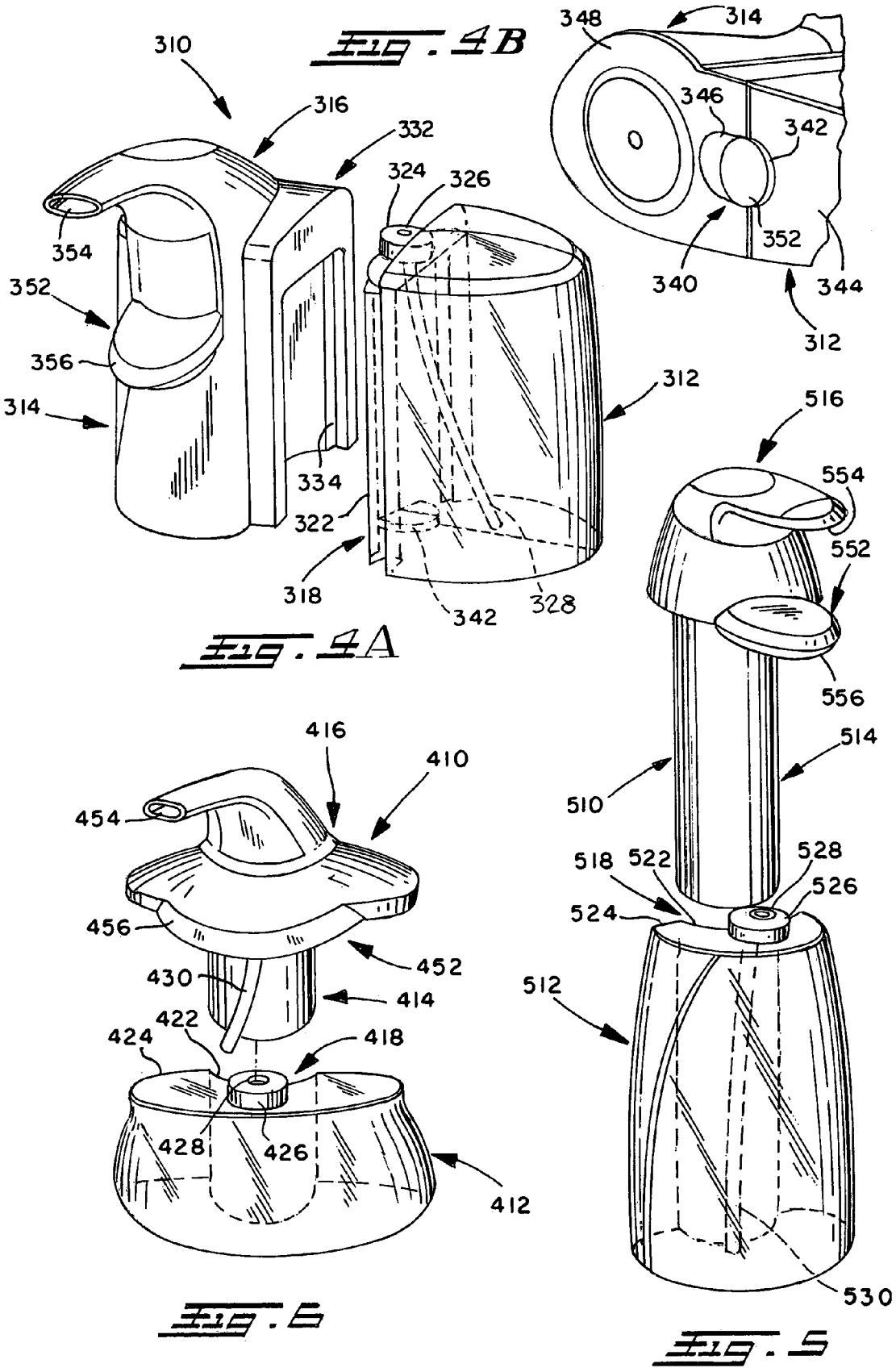
FIG. 4A is a front perspective view of a dispenser according to another embodiment showing a container removed from a housing.
FIG. 4B is a close-up view of the bottom of the dispenser of FIG. 4A.
FIG. 5 is a front perspective view according to another embodiment showing a container removed from a housing.
FIG. 6 is a front perspective view according to another embodiment showing a container removed from a housing.

Referring to FIGS. 4A and 4B, an alternative embodiment of a dispenser 310 is disclosed. The dispenser 310 includes a container 312, a housing 314 and a shroud 316. The container 312 stores a household liquid, similar to the container 12 disclosed above. The container 312 includes a mounting portion 318 that includes two tongues 322, one on each side. The container also includes a neck (not visible) that defines an opening (not visible). A container seal 324 mounts to the neck and includes an opening 326 that aligns with and communicates with an opening (not visible) in the housing 314.

The pump assembly, drive mechanism and power supply used to drive the pump assembly is similar to that described above in FIGS. 3A and 3B. For the sake of brevity, their description will not be provided. However, in the embodiment depicted in FIG. 5, the pump assembly with the exception of a dip tube 328 is disposed in the housing 314 or shroud 316. The dip tube 328 is received in the opening 326 of the container seal 324 and communicates with the pump assembly via the opening (not visible) in the housing 314 or shroud 316.

The housing 314 can be made of plastic or another durable material. In this embodiment, the housing 314 and the shroud 316 are a unitary structure; however, in an alternative embodiment, the shroud 316 can be a separate component from the housing 314. The housing includes a mounting portion 332 that receives the mounting portion 318 of the container 312. In this embodiment, the mounting portion 332 of the housing 314 is shown at a side of the housing 314, but the mounting portion can be positioned elsewhere, such as at the rear of the housing 314. The mounting portion 332 of the housing 314 includes two grooves 334 (only one is visible) that receive the two tongues 322 of the container 312. The housing 314 can also include a removable wall (not shown) to provide access to the power source.

Referring to FIG. 4B, a latching mechanism 340 is provided to further hold the container 312 in a fixed relation to the housing 314. The container 312 includes a notch 342 in a base wall 344 that aligns with a notch 346 in a base wall 348 of the housing 314. A latch plate 352 slides along in the notches 342 and 346 to selectively hold the container 312 to the housing 314.

A trigger assembly 352 is positioned below an outlet 354 of the dispenser 310. The trigger assembly 352 includes a trigger pad 356 and components similar to the trigger assembly described with reference to FIG. 3A. The trigger assembly 352 is movably mounted to the housing 314. In this embodiment, the trigger assembly actuates a switch (not visible) in response to a slight downward and/or lateral pressure on the trigger pad 356. The trigger assembly 352 is limited in movement by the housing 314.

Referring to FIG. 5, another embodiment of a dispenser 410 in exploded view is disclosed. In this embodiment the dispenser 410 includes a container 412, a housing 414 and a shroud 416. The container 412 stores a household liquid, similar to the container 12 disclosed above. The container 412 includes a receiving portion 418, which in this embodiment is an arcuate depression 422 in a rear wall 424 of the container 412. The container 412 also includes a neck (not visible) that defines an opening (not visible). A container seal 426 mounts to the neck and includes an opening 428 that aligns with and communicates with an opening (not visible) in the housing 414 or shroud 416.

Figure 8:
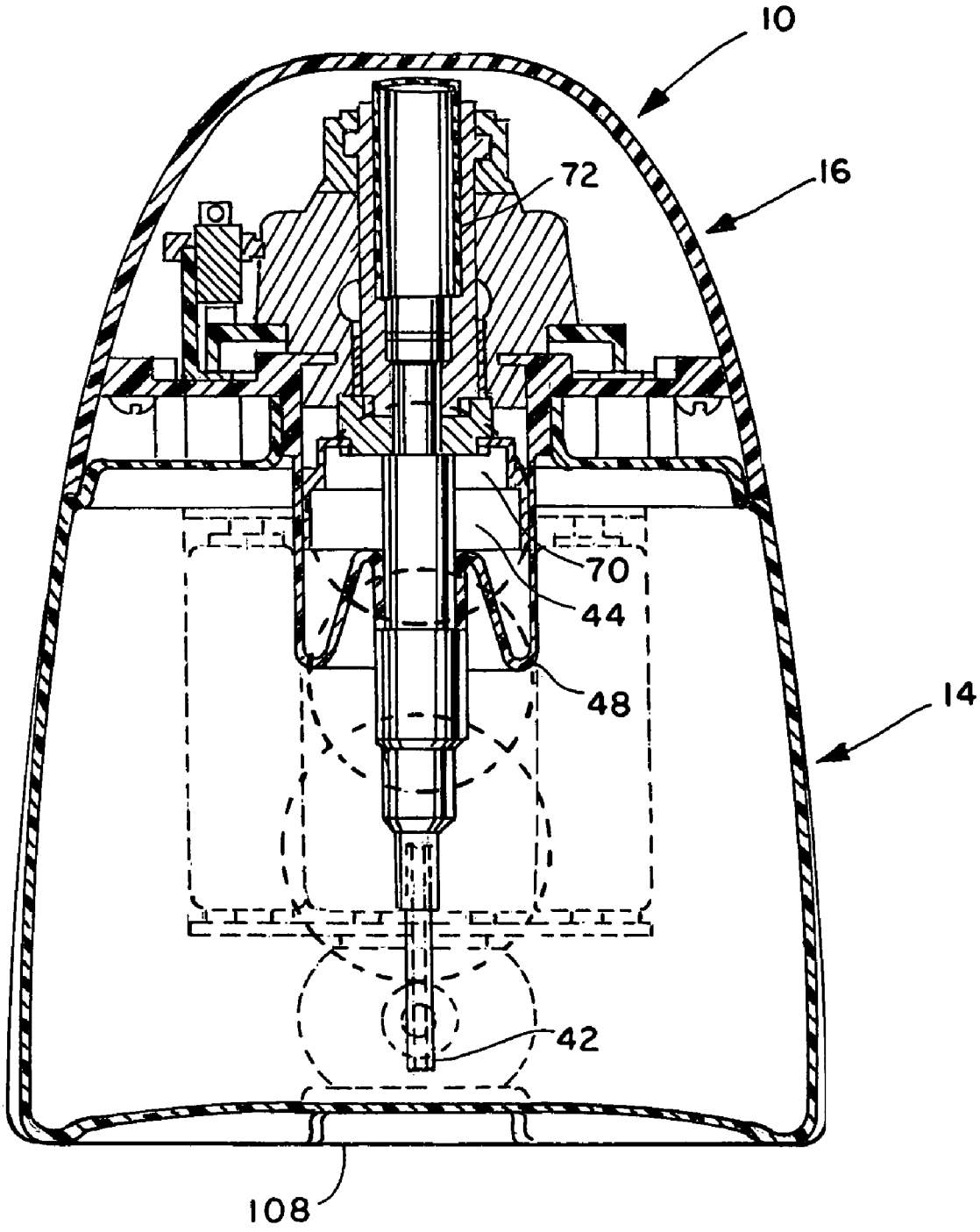
FIG. 8 is a rear cross-sectional view of the dispenser of FIG. 1.

The pump assembly, drive mechanism and power supply used to drive the pump assembly is similar to that described above in FIGS. 3A and 3B. For the sake of brevity, their description will not be provided. However, in the embodiment depicted in FIG. 8, the pump assembly with the exception of a dip tube 430 is disposed in the housing 414 or shroud 416. The dip tube 430 is received in the opening 428 of the container seal 426 and communicates with the pump assembly via the opening (not visible) in the housing 414 or shroud 416.

The housing 414 can be made of plastic or another durable material. In this embodiment, the housing 414 and the shroud 416 are a unitary structure; however, in an alternative embodiment, the shroud 416 can be a separate component from the housing 414. Furthermore, the shroud 416 may be removable from the housing 414 to provide access to the power source of the pump assembly. The housing 414 is received in the receiving portion 418 of the container 412. In this embodiment, the housing 414 is received at the rear of the housing 414, but the receiving portion 418 can be positioned elsewhere, such as at the side or front of the housing 414. The housing 414 has a complementary shape to the receiving portion 418 of the container 412. A latching mechanism similar to that described with reference to FIG. 4B or FIG. 7 can be provided to fix the container 412 in relation to the housing 414.

A trigger assembly 452 is positioned below an outlet 454 of the dispenser 410. The trigger assembly 452 includes a trigger pad 456 and components similar to the trigger assembly described in FIG. 3. The trigger assembly 452 is movably mounted to the shroud 416. In this embodiment, the trigger assembly actuates a switch (not visible) in response to a slight downward and/or lateral pressure on the trigger pad 456. The trigger assembly 452 is limited in movement by the container 412.

Referring to FIG. 5, another embodiment of a dispenser 510 in exploded view is disclosed. In this embodiment the dispenser includes a container 512, a housing 514 and a shroud 516. The container 512 stores a household liquid, similar to the container 12 disclosed above. The container 512 includes a receiving portion 518, which in this embodiment is an arcuate depression 522 in a rear wall 524 of the container 512. The container 512 also includes a neck (not visible) that defines an opening (not visible). A container seal 526 mounts to the neck and includes an opening 528 that aligns with and communicates with an opening (not visible) in the housing 514 or shroud 516.

The pump assembly, drive mechanism and power supply used to drive the pump assembly is similar to that described above in FIGS. 3A and 3B. For the sake of brevity, their description will not be provided. However, in the embodiment depicted in FIG. 5, the pump assembly is with the exception of a dip tube 530 disposed in the housing 514 or shroud 516. The dip tube 530 is received in the opening 528 of the container seal 526 and communicates with the pump assembly via the opening (not visible) in the housing 514 or shroud 516.

The housing 514 can be made of plastic or another durable material. In this embodiment, the housing 514 and the shroud 516 are a unitary structure; however, in an alternative embodiment, the shroud 516 can be a separate component from the housing 514. Furthermore, the shroud 516 may be removable from the housing 514 to provide access to the power source of the pump assembly. The housing 514 is received in the receiving portion 518 of the container 512. In this embodiment, the housing 514 is received at the rear of the housing 514, but the mounting portion can be positioned elsewhere, such as at the side of the housing 514. The housing 514 has a complementary shape to the receiving portion 518 of the container 512. A latching mechanism similar to that described with reference to FIG. 4B or FIG. 7 can be provided to fix the container 512 in relation to the housing 514.

A trigger assembly 552 is positioned below an outlet 554 of the dispenser 510. The trigger assembly 552 includes a trigger pad 556 and components similar to the trigger assembly described in FIG. 3. The trigger assembly 552 is movably mounted to the shroud 516. In this embodiment, the trigger assembly actuates a switch (not visible) in response to a slight downward pressure on the trigger pad 556. The trigger assembly 552 is limited in movement by the container 516.

In each of the dispensers a screen 250 (FIG. 3B) or a plurality of screens and/or aspiration opening can be provided in the fluid flow path through the pump assembly to transform the liquid soap in the bottle to a foam at the outlet of the nozzle extension. The screen 250 provides a mixing apparatus to convert the liquid soap into a foam. Furthermore, as apparent from the different embodiments described, the dispenser can take many configurations. The container can take a multitude of configurations, as well as the trigger assembly, housing and shroud.

Figure 9:
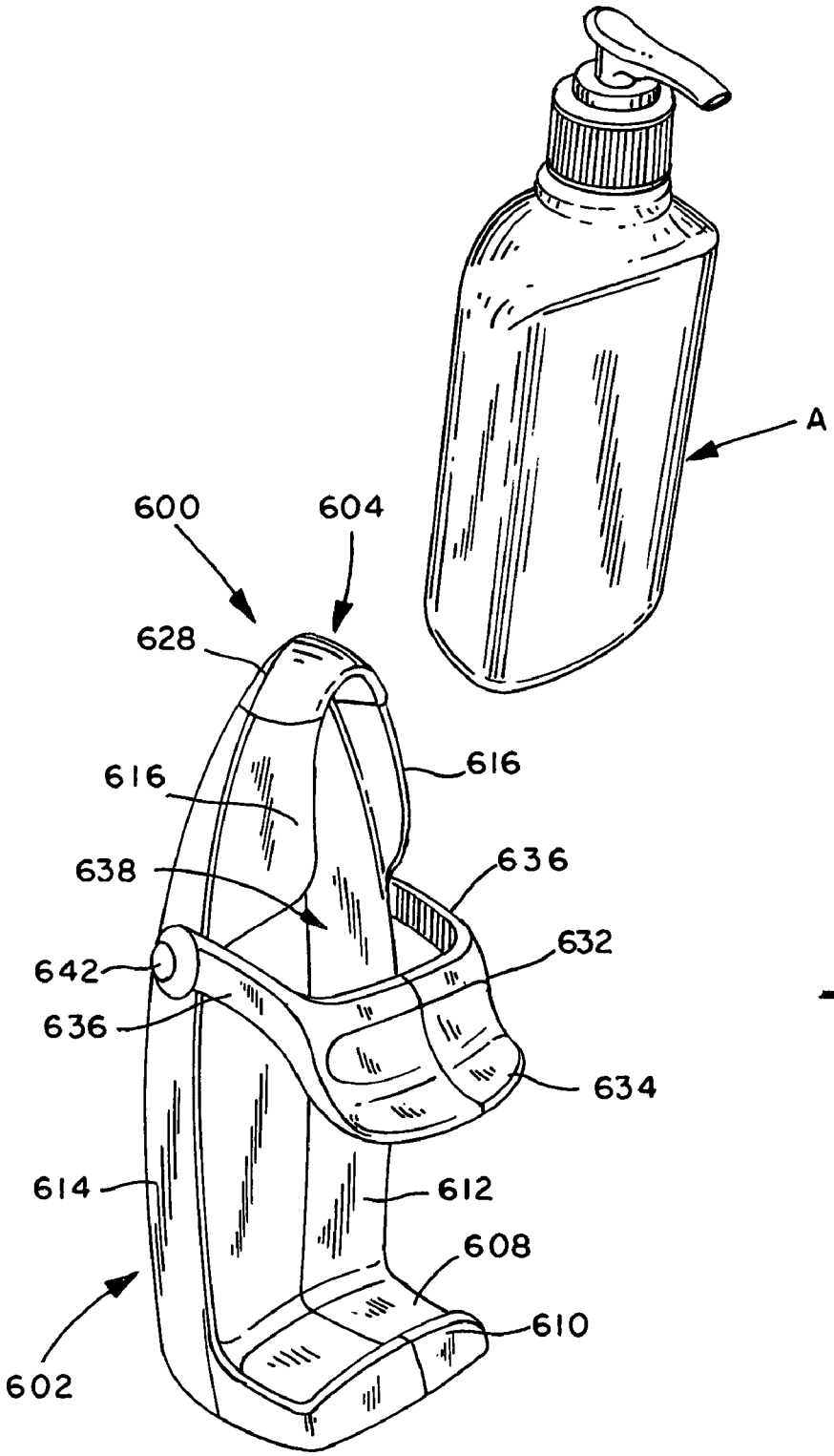
FIG. 9 is a front perspective view of a dispensing apparatus used to dispense household liquid from a conventional retail hand soap pump.

With reference to FIG. 9, a dispensing apparatus 600 can also be used with a conventional retail hand soap pump bottle A. The dispensing apparatus 600 includes a housing 602 to receive the pump bottle A, an actuator assembly 604 to drive the pump of the pump bottle A, and a trigger assembly 606 to actuate the actuator assembly. The conventional pump bottle A includes a container for storing liquid hand soap, a pump (not shown) disposed in the container for pumping the hand soap out of the container, a pump driving member and an outlet for the hand soap. The pump driving member for the pump bottle A depicted in the figures is the nozzle of the pump bottle, which normally a user depresses with one hand to dispense the liquid soap from inside the container onto his other hand.

Figure 10:
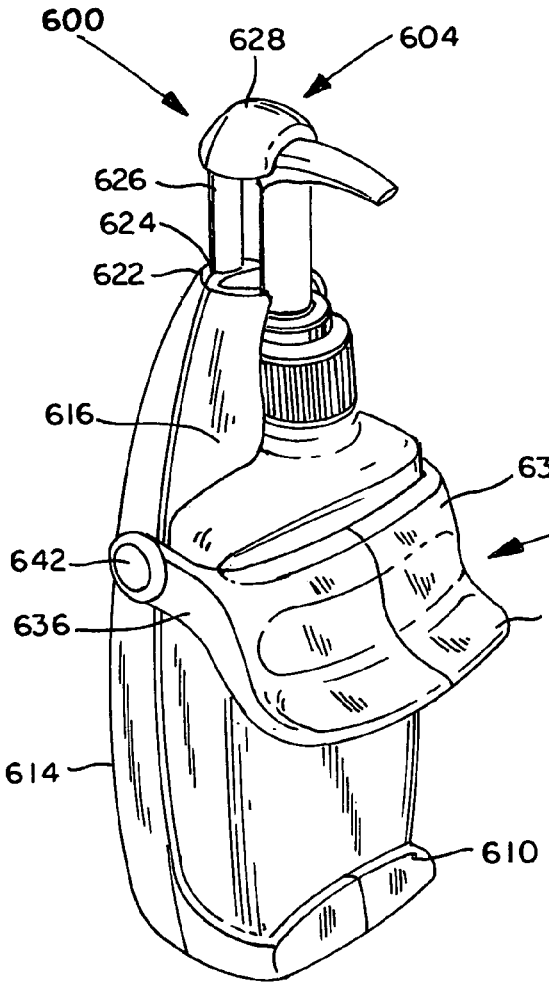
FIG. 10 is a front perspective view of the dispensing apparatus of FIG. 9 having received a conventional retail hand soap pump bottle with the dispensing apparatus and the hand soap pump in an upstroke.
Figure 11:
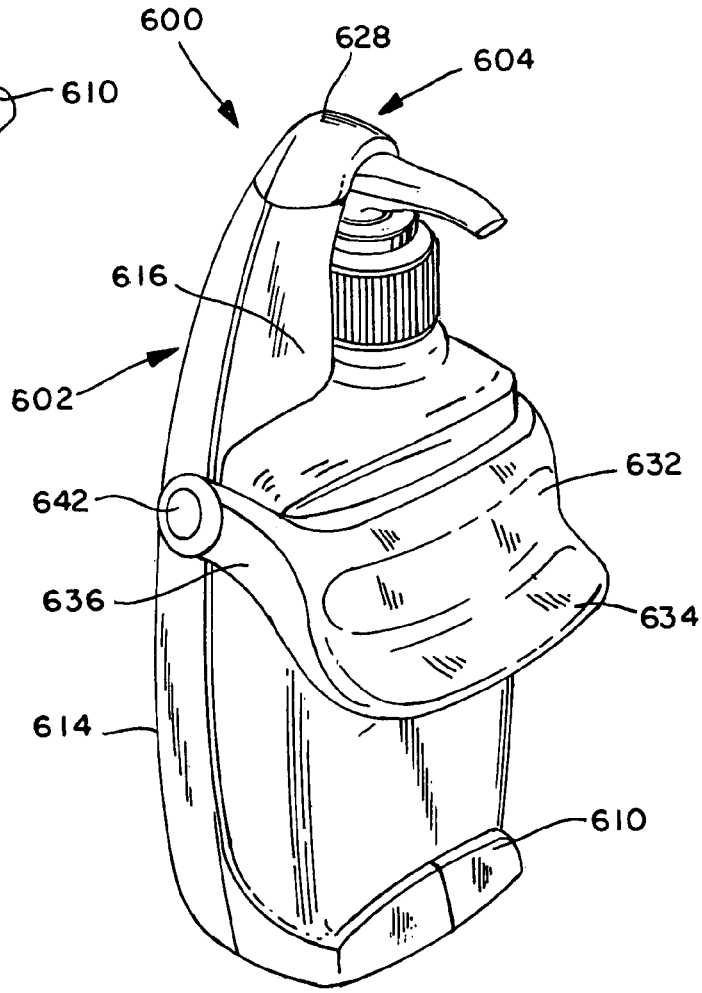
FIG. 11 is a front perspective view of the dispensing apparatus of FIG. 9 having received a conventional retail hand soap pump bottle with the dispensing apparatus and the hand soap pump in a downstroke.

The housing 602 includes a platform 608 upon which the bottom of the pump bottle A rests, as seen in FIGS. 10 and 11. The platform 608 is generally rectangular to complement the bottom of the container of the pump bottle A. A small projection 610 extends upwardly from an end of the platform 608. Projecting upwardly from the platform 608 and spaced from the projection 610, a housing front wall 612 along with a housing rear wall 614 enclose the major mechanical and electrical components of the dispensing apparatus 600. The projection 610 and the front wall 612 are spaced such that the container of the pump bottle A can be received on the platform 608. Attached to the front wall 612, two upper side walls 616 project outwardly and cover an upper portion of the pump bottle A (FIGS. 10 and 11). The side walls 616 are spaced from the platform 608 such that the side walls cover a top wall of the container of the pump bottle A. Referring to FIG. 10, the housing includes a top wall 622 having an opening 624. The front of the housing 602 is substantially open, as noticeable from the figures.

The actuator assembly 604 drives the pump of the pump bottle. Referring to FIG. 10, the actuator assembly includes a rod 626 that is received in the opening 624 in the top wall 622 and a follower 628 attached to an end of the rod 626. The rod 626 is driven by a motor and transmission similar to that described with reference to FIG. 3A, and therefore for the sake of brevity will not be described in much detail. Basically, a motor through a gear reduction transmission that translates the rotational movement of the motor into a reciprocating motion of the actuator assembly 604 drives the rod 626. The motor is powered by a conventional power source, including batteries and/or a plug that can fit into a wall receptacle. The motor, transmission and batteries are enclosed by the front wall 612 and the rear wall 614 of the housing 602.

The follower 628 engages a portion of the nozzle of the pump bottle A to drive the nozzle up and down, thus dispensing liquid soap from the container. The follower 628 can engage the nozzle in any conventional manner that allows the nozzle to travel along with the follower. For example, the follower can include a U-shaped member that receives an underside of the nozzle to pull the nozzle up on an upstroke, and a portion of the follower can push the nozzle down on a downstroke. Similarly, the follower 628 can simply depress the nozzle on its downstroke and the nozzle can return due to the biasing action provided by a spring (not shown) in the pump of the pump bottle A. This biasing is the usual action of a conventional retail soap bottle pump where the user of which depresses the nozzle to dispense soap.

The trigger assembly 606 actuates the actuator assembly 604. The trigger assembly 606 includes a trigger 632 having a trigger pad 634 formed at a distal end of the trigger. The trigger 632 mounts to the housing 602 above the platform 608 and below the follower 628 on the same side of the housing 602 as the platform. The trigger 632 also includes a pair of arms 636 that attach to the housing 602. The trigger arms 636, the trigger 632 and the front wall 612 of the housing 602 define an opening 638 (FIG. 9) through which the pump bottle A is received. The opening 638 is shaped similarly yet slightly larger than the container of the pump bottle A. In this embodiment, the opening 638 is substantially rectangular and slightly larger than the platform 608. The trigger 632 mounts to the housing 602 by use of an axle 642.

The trigger assembly 606 closes a switch similar to the trigger assembly described with respect to FIG. 3A. The trigger 632 pivots about the axle 642 in response to a downward and/or lateral force on the trigger. The axle 642 can pivot such that a portion of the axle contacts a switch that closes the circuit between the power source and the motor. The trigger 632 can close the switch in other conventional manners. Upon depression of the trigger pad 634, the actuator assembly 604 drives the nozzle of the pump bottle A to dispense hand soap. The trigger 632 is positioned under the nozzle outlet of the pump bottle A when the pump bottle is received by the housing 602. Accordingly, the same hand that activates the trigger 632 is also in position to receive a dose of liquid hand soap. Furthermore, since the trigger 632 is pivotally mounted and the nozzle is mechanically driven, a smaller force is needed by the user to activate the dispensing apparatus 600 than is required to dispense liquid soap from the pump bottle A in a conventional manner. Also, the back of the handwasher's hand, which is usually not soiled, can be used to activate the trigger 632. A small force is used to activate the trigger 632 and the trigger is limited in is rotation by the container of the pump bottle A.

Accordingly, a dispenser that fulfills all of the above-mentioned objectives has been provided. The invention has been described with reference to preferred embodiments. Obviously, modifications and alterations will occur to others upon reading and understanding the proceeding detailed description. It is intended that the invention described be construed to include all modifications and alterations as encompassed by the appended claims.

What is claimed is:

1. A household liquid dispensing apparatus comprising:

a container for holding a household liquid;

a pump for pumping the household liquid out of the container, the pump having a pump chamber;

a dip tube adapted to be positioned in said container and in communication with the pump chamber;

an exhaust tube in communication with the pump chamber and an outlet for the household liquid;

a pump actuator for mechanically driving said pump, said pump actuator connected to said pump;

a motor operatively engaging said pump actuator, said motor electrically connected to a power source;

a switch electrically connected to said motor and the power source; and a trigger operatively connected to said switch to control power delivered to said motor, said trigger positioned under the outlet for the household liquid; wherein the trigger is positioned in relation to the outlet such that the same hand of the user that mechanically actuates the trigger is also positioned to receive household liquid from the outlet.

2. The apparatus of claim 1, wherein said trigger is adapted to be actuated by a user when the user slightly depresses the back of his hand on a portion of said trigger.

3. The apparatus of claim 1, wherein said trigger comprises a trigger assembly, the trigger assembly includes a trigger pad positioned below the outlet.

4. The apparatus of claim 3, wherein the trigger pad is positioned in relation to the outlet such that an object that exerts a force on the trigger pad is also positioned to receive the household liquid dispensed from the outlet.

5. The apparatus of claim 3, further comprising a housing for said motor, wherein the trigger assembly includes a switch actuator pivotally mounted to one of said housing and said container, wherein the trigger pad is mounted to the switch actuator.

6. The apparatus of claim 5, wherein said housing includes a front wall and said container includes a rear wall disposed adjacent the front wall of said housing.

7. The apparatus of claim 6, wherein the front wall of said housing and the rear wall of said container are complementarily shaped.

8. The apparatus of claim 5, further comprising a latch plate for securing said housing in relation to said container.

9. The apparatus of claim 8, wherein said housing includes a notch and said container includes a notch aligned with the notch of the housing, wherein said latch plate is slidably disposed in the notches.

10. The apparatus of claim 9, wherein said housing includes a depression and said latch includes a protrusion, wherein said depression and said protrusion cooperate to secure said container in relation to said housing.

11. The apparatus of claim 3, further comprising a housing for said motor, wherein the trigger assembly includes a switch actuator movably mounted to one of said housing and said container, wherein the trigger pad is mounted to the switch actuator.

12. The apparatus of claim 11, wherein the trigger pad and the switch actuator are mounted such that the trigger assembly activates the switch in response to slight downward pressure on the trigger pad.

13. The apparatus of claim 11, wherein the trigger pad is positioned in relation to the outlet such that an object that exerts a force on the trigger pad is also positioned to receive the household liquid dispensed from the outlet.

14. The apparatus of claim 1, further comprising a housing wherein said housing includes a first wall and said container includes a first wail disposed adjacent the first wall of said housing.

15. The apparatus of claim 14, wherein the first wall of said housing and the first wall of said container are complementarily shaped.

16. The apparatus of claim 15, further comprising a latch for securing said housing in relationship to said container.

17. The apparatus of claim 16, wherein said housing includes a notch and said container includes a notch aligned with the notch of the housing, wherein said latch comprises a latch plate slidably disposed in the notches.

18. The apparatus of claim 17, wherein said housing includes a depression and said latch plate includes a protrusion, wherein said depression and said protrusion cooperate to secure said container in relationship to said housing.

19. The apparatus of claim 15, wherein the first wall of the housing includes a tongue and the first wall of the container includes a groove, wherein the groove is adapted to fit into the tongue to attach the container to the housing.

20. The apparatus of claim 1, further comprising a mixing apparatus disposed in said exhaust tube.

21. The apparatus of claim 20, wherein said mixing apparatus comprises a screen.

22. The apparatus of claim 1, further comprising a shroud covering the exhaust tube.

23. The apparatus of claim 22, further comprising a housing for said pump and said motor.

24. The apparatus of claim 23, wherein said shroud and a portion of said housing are an integral plastic unit.

25. The apparatus of claim 23, wherein said container is removable from said housing and said shroud.

26. The apparatus of claim 1, wherein said motor operatively engages said pump actuator via a gear reduction transmission.

27. The apparatus of claim 1, wherein the power source comprises at least one battery.

28. A household liquid dispenser for use with an associated bottle for storing a household liquid, the dispenser comprising:

a housing;

a pump for pumping a household liquid from the associated bottle, said pump at least partially disposed in said housing and including a pump chamber;

a nozzle in fluid communication with the pump chamber and defining an outlet;

a pump actuator connected to said pump for working said pump;

a motor operatively engaging said pump actuator and electrically connected to a power source;

a switch electrically connected to said motor and the power source for selectively supplying power to said motor; and a trigger mounted to said housing and selectively mechanically engaging said switch, wherein said trigger comprises a trigger assembly that includes a trigger pad positioned below the outlet of said nozzle.

29. The dispenser of claim 28, wherein said trigger is adapted to engage said switch in response to downward or lateral pressure applied to said trigger.

30. The dispenser of claim 28, wherein said trigger is pivotally mounted to said housing.

31. The dispenser of claim 30, wherein said trigger comprises a first portion that engages said switch and a second portion depending from said first portion, wherein the second portion is adapted to pivot in response to a force applied to the second portion whereby the first portion engages said switch.

32. The dispenser of claim 28, wherein said housing is adapted to connect to the associated bottle.

33. The dispenser of claim 32, further comprising a latching mechanism to connect said housing to the associated bottle.

34. The dispenser of claim 32, wherein said housing comprises a base wall that aligns with a base wall of the associated bottle when said housing is attached to the associated bottle.

35. The dispenser of claim 32, wherein said housing includes a wall having a shape that is complementary to an adjacent wall of the associated bottle when said housing is connected to the associated bottle.

36. The dispenser of claim 28, further comprising a dip tube adapted to be positioned in the associated bottle.

37. The dispenser of claim 32, further comprising a dip tube adapted to be positioned in the associated bottle.

38. The dispenser of claim 37, wherein said housing includes an opening that communicates with said dip tube.

39. The dispenser of claim 38, wherein the opening in said housing aligns with an opening in the associated bottle when the associated bottle is attached to said housing.

40. The dispenser of claim 28, wherein said motor operatively engages said pump actuator via a transmission that translates rotational movement to reciprocal movement.

41. The dispenser of claim 40, wherein said motor engages said pump via a gear reduction transmission.

42. The dispenser of claim 28, wherein said pump comprises a positive displacement pump.

43. The dispenser of claim 28, wherein said housing includes a shroud that at least partially covers said nozzle.

* * * * *

UNITED STATES PATENT AND TRADEMARK OFFICE

CERTIFICATE OF CORRECTION

PATENT NO. : 7,191,920 B2
APPLICATION NO. : 10/669761
DATED : March 20, 2007
INVENTOR(S) : Boll et al.

It is certified that error appears in the above-identified patent and that said Letters Patent is hereby corrected as shown below:

In column 2, line 48, please change "FIG. 3A …" to:

FIG. 3B …

In column 2, line 50, please change "FIG. 3B …" to:

FIG. 3A …

In column 7, line 46, please change "Referring to FIG. 5, …" to:

Referring to FIG. 6, ...

Signed and Sealed this

Sixth Day of January, 2009

JON W. DUDAS
*Director of the United States Patent and Trademark Office*